US006827139B2

(12) United States Patent
Kawakubo et al.

(10) Patent No.: US 6,827,139 B2
(45) Date of Patent: Dec. 7, 2004

(54) HEAT EXCHANGER FOR EXCHANGING HEAT BETWEEN INTERNAL FLUID AND EXTERNAL FLUID AND MANUFACTURING METHOD THEREOF

(75) Inventors: Masaaki Kawakubo, Obu (JP); Ken Muto, Toyota (JP); Norihide Kawachi, Kariya (JP); Ken Yamamoto, Obu (JP); Etsuo Hasegawa, Nagoya (JP); Yoshiki Katoh, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/405,433

(22) Filed: Apr. 2, 2003

(65) Prior Publication Data

US 2003/0188857 A1 Oct. 9, 2003

(30) Foreign Application Priority Data

Apr. 3, 2002 (JP) ..... 2002-101327
Feb. 4, 2003 (JP) ..... 2003-027578

(51) Int. Cl.[7] ..... F28F 9/02
(52) U.S. Cl. ..... 165/173; 165/174; 165/176
(58) Field of Search ..... 165/173–176

(56) References Cited

U.S. PATENT DOCUMENTS 5,205,347 A * 4/1993 Hughes ..... 165/176
5,415,223 A * 5/1995 Reavis et al. ..... 165/96
6,216,776 B1 * 4/2001 Kobayashi et al. ..... 165/173
6,449,979 B1 9/2002 Nagasawa et al.
6,494,253 B2 * 12/2002 Gotou et al. ..... 165/115

* cited by examiner

*Primary Examiner*—Allen J. Flanigan
(74) *Attorney, Agent, or Firm*—Harness, Dickey & Pierce, PLC

(57) ABSTRACT

A heat exchanger includes aligned tubes and upper and lower header tank units, each of which includes two fluid conduits communicated with the tubes. Each header tank unit further includes an intermediate plate, which defines a plurality of communication holes therethrough. Each communication hole communicates between a corresponding one of the tubes and a corresponding one of chambers defined by the fluid conduits of the header tank unit such that each tube is spaced apart from the corresponding one of the chambers.

20 Claims, 11 Drawing Sheets

HEAT EXCHANGER FOR EXCHANGING HEAT BETWEEN INTERNAL FLUID AND EXTERNAL FLUID AND MANUFACTURING METHOD THEREOF

CROSS REFERENCE TO RELATED APPLICATION

This application is based on and incorporates herein by reference Japanese Patent Application No. 2002-101327 filed on Apr. 3, 2002 and Japanese Patent Application No. 2003-27578 filed on Feb. 4, 2003.

BACKGROUND OF THE INVENTION

1. Field of the Invention

The present invention relates to a heat exchanger, such as an evaporator of a vehicle air conditioning system.

2. Description of Related Art

For example, Japanese Unexamined Patent Publication No. 2001-74388 discloses a heat exchanger. The disclosed heat exchanger is an evaporator of a vehicle air conditioning system and includes a plurality of tubes. The tubes are arranged in two rows, which are arranged in a flow direction of external fluid that flows outside of the evaporator. In each row of tubes, opposed upper and lower ends of each tube are directly connected to adjacent upper and lower tank arrangements, respectively, such that the tubes and the tank arrangements form a refrigerant flow passage. Partition walls are arranged in the tank arrangements. The partition walls allow the refrigerant to flow through a refrigerant flow passage section defined in one of the two rows of tubes in one direction and then flows through a refrigerant flow passage section defined in the other one of the two rows of tubes in an opposite direction opposite to the one direction. Furthermore, a plurality of throttle plates are arranged in predetermined positions in the corresponding tank arrangement to reduce a passage cross sectional area in the tank arrangement.

With the above arrangement, a refrigerant inlet side refrigerant passage section, in which a relatively large amount of liquid phase refrigerant exists near a refrigerant inlet, and a refrigerant outlet side refrigerant passage section, in which a relatively large amount of vapor phase refrigerant exists near a refrigerant outlet, are arranged in series in the flow direction of external fluid. Thus, even when the flow rate of the refrigerant is relatively small, the temperature distribution of the outlet air discharged from the evaporator becomes more uniform.

Furthermore, the throttle plates allow adjustment of distribution of the refrigerant, and the unequal distribution of the refrigerant is alleviated by the arrangement of the tubes in the two rows, which are placed one after the other in the flow direction of external fluid to provide more uniform temperature distribution of the outlet air discharged from the evaporator.

However, in order to adjust the temperature distribution of the outlet air discharged from the evaporator in a more precise manner, the number of throttle plates needs to be disadvantageously increased, resulting in an increase in the number of the components. Furthermore, the increase in the number of throttle plates results in an increase in pressure loss of the refrigerant. Also, since each tube is directly connected to the corresponding tank arrangement such that an end of the tube protrudes into an internal flow passage of the tank arrangement, the end of the tube could restrain smooth flow of refrigerant through the tank arrangement and could result in an increase in pressure loss of the refrigerant.

SUMMARY OF THE INVENTION

The present invention addresses the above disadvantage, and thus it is an objective of the present invention to provide a heat exchanger, which is capable of minimizing pressure loss of internal fluid and is also capable of improving temperature distribution of external fluid with a relatively simple structure. It is another objective of the present invention to provide a manufacturing method of such a heat exchanger.

To achieve the objectives of the present invention, there is provided a heat exchanger for exchanging heat between internal fluid inside the heat exchanger and external fluid outside the heat exchanger. The heat exchanger includes a plurality of aligned tubes and at least one header tank unit, each of which includes a plurality of fluid conduits communicated with the plurality of tubes. Each header tank unit further includes a communication hole defining means for defining a plurality of communication holes therethrough. Each communication hole communicates between a corresponding one of the plurality of tubes and a corresponding one of the plurality of fluid conduits of the header tank unit such that each tube is spaced apart from the corresponding one of the plurality of fluid conduits.

To achieve the objectives of the present invention, there is also provided a manufacturing method of a heat exchanger. According to the method, a plurality of communication holes is formed through an intermediate plate. Then, a header tank unit, which includes the intermediate plate, is assembled. Thereafter, a plurality of tubes is installed to the header tank unit. Then, the tubes are joined to the header tank unit by soldering.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

Figure 1:
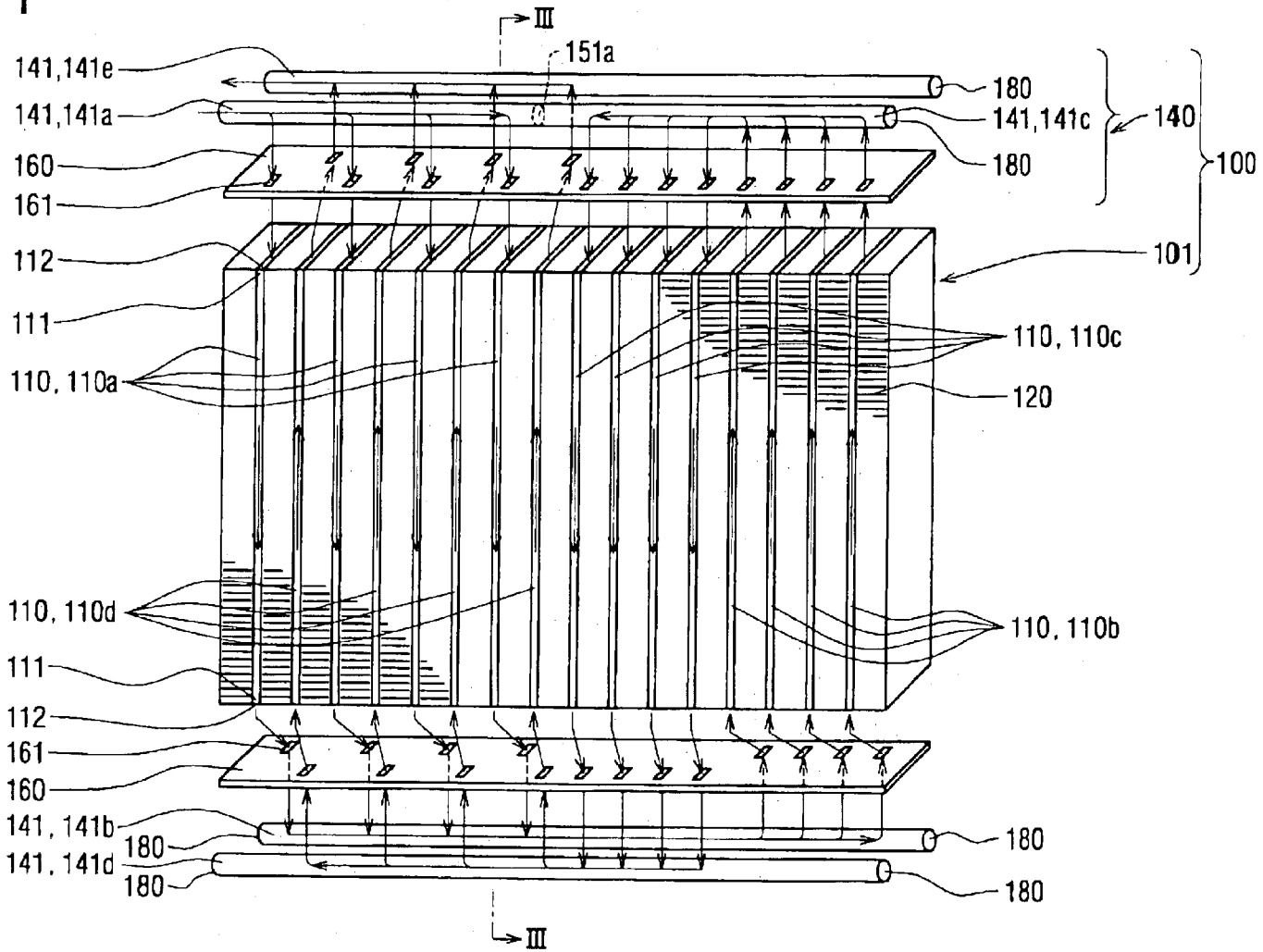
FIG. 1 is a schematic perspective view showing a partially disassembled state of an evaporator according to a first embodiment of the present invention, indicating a structure of the evaporator and flow of refrigerant in the evaporator.

An evaporator, which serves as a heat exchanger, according to a first embodiment of the present invention will be described with reference to FIGS. 1 to 3. The evaporator 100 is arranged in a refrigeration cycle. It will be appreciated that the representation of FIG. 1 is for the purpose of schematically illustrating flow of refrigerant (internal fluid of the present invention) in the evaporator 100 and has been greatly simplified from actual arrangement of the evaporator 100, and thus details of a tank arrangement 150 and a tank plate arrangement 170 of each header tank unit 140 described below are eliminated in FIG. 1.

The evaporator 100 includes a core unit 101 and a pair of header tank units (upper and lower header tank units, or alternatively referred to as first and second header tank units) 140. Component (described below) of the core unit 101 and the header tank units 140 are made of aluminum or an alloy thereof and are integrated by fitting, staking or securing with a jig or the like and are joined by soldering using a soldering material previously applied to a surface of the corresponding component.

The core unit 101 includes a plurality of generally flattened tubes 110, which are aligned in an aligning direction. Refrigerant flows through the tubes 110. A plurality of wavy fins 120 is arranged between corresponding adjacent tubes 110 and is integrally joined to these tubes 110 by soldering. Furthermore, a plurality of wavy fins 120 is integrally joined to an outer surface of each of left and right end tubes 110 in FIG. 1. Optionally, a pair of side plates can be placed laterally outward of the wavy fins 120 on the left and right ends of the core unit 101 to reinforce the core unit 101.

The header tank units 140 are connected to upper and lower ends of the core unit 101, i.e., are connected to upper and lower tube ends 111 of the tubes 110 such that the head tank units 140 extend in the aligning direction of the tubes 110. With reference to FIG. 2, each header tank unit 140 includes a tank arrangement 150, an intermediate plate (serving as a communication hole defining means) 160 and a tank plate arrangement 170.

The tank arrangement 150 is formed through press working of a flat plate material. Two flat portions (both lying in a common imaginary plane) 152 are provided on opposed lateral sides of the tank arrangement 150, and two protrusions 153 are arranged between the flat portions 152. Each protrusion 153 extends in the aligning direction of the tubes 110 and defines a fluid conduit (also referred to as an internal space) 141 therein. A flat partition wall 151 is arranged between the protrusions 153 to separate the fluid conduits 141 from each other. In the upper tank arrangement 150 located in the upper side in FIG. 1, a separator 151*a*, which serves as a partition wall, is arranged in one of the fluid conduits 141 generally at the longitudinal center of the fluid conduit 141. Thus, the fluid conduits 141 of the upper and lower tank arrangements 150 form first to fifth chambers 141*a*–141*e*, as shown in FIG. 1.

Each intermediate plate 160 is arranged between the corresponding chambers 141*a*–141*e* and the openings 112 of the corresponding tube ends 111 of the tubes 110 and is made of a flat plate material that extends in the aligning direction of the tubes 110. The intermediate plate 160 has a plurality of communication holes 161, which are formed by press working and are arranged at predetermined positions such that each communication hole 161 communicates between the corresponding chamber 141*a*–141*e* and the corresponding tube end 111. The positions of the communication holes 161 will be further described below.

The tank plate arrangement 170 includes a first tank plate 171 and a second tank plate 172. Similar to the intermediate plate 160, the first tank plate 171 is made of a flat plate material that extends in the aligning direction of the tubes 110 and has a plurality of plate holes 171*a* at predetermined positions, each of which corresponds to the position of the corresponding tube end 111. A step 171*b* (FIG. 3) is formed in each of opposed longitudinal ends of an elongated cross sectional area of each plate hole 171*a* to limit the position of the tube end 111 at an intermediate point in the thickness of the first tank plate 171. Furthermore, each plate hole 171*a* has a cross sectional area larger than a cross sectional area of the corresponding tube end 111 to reduce inflow resistance of refrigerant, which flows into the corresponding tube 110, and also to reduce outflow resistance of refrigerant, which flows out from the corresponding tube 110. More specifically, the width "a" of each plate hole 171*a* is larger than the thickness (measured in a direction perpendicular to a longitudinal direction of the elongated cross sectional area of the tube 110) "b" of the tube 110. In this embodiment, the width "a" of the plate hole 171*a* is generally twice greater than the thickness "b" of the tube 110.

Figure 2:
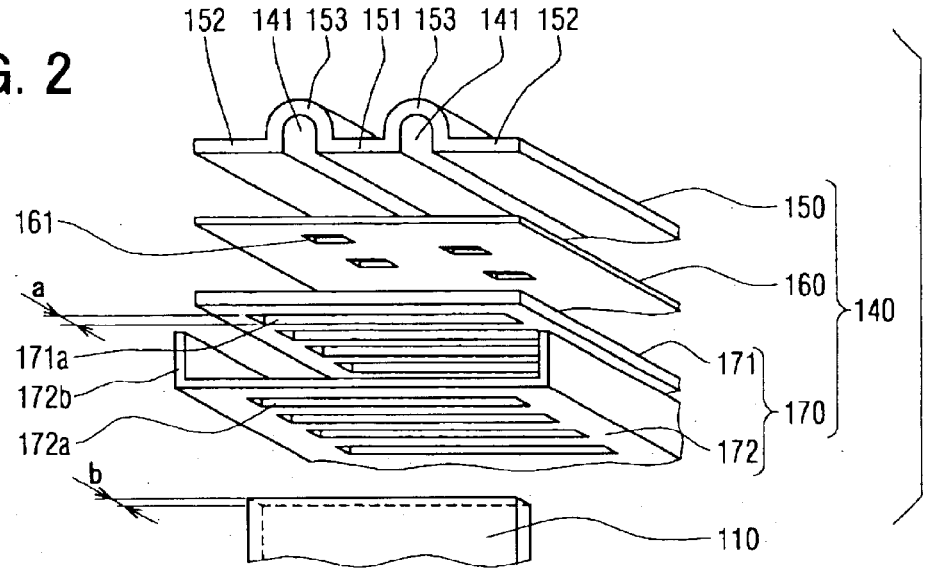
FIG. 2 is a schematic perspective view showing a disassembled state of a header tank unit of the evaporator according to the first embodiment.

The second tank plate 172 has opposed two claws 172*b*, which are formed by bending opposed lateral edge sections of a flat plate material, so that the second tank plate 172 has a horseshoe shape, as shown in FIG. 2. A plurality of tube receiving holes 172*a* is formed in a flat section between the claws 172*b* in the second tank plate 172 at predetermined positions, each of which corresponds to the position of the corresponding plate hole 171*a*.

The tank arrangement 150, the intermediate plate 160, the first tank plate 171 and the second tank plate 172 are aligned in the manner shown in FIG. 2 and are held together by the claws 172*b* of the second tank plate 172 and are thereafter soldered together to form the header tank unit 140. Longitudinal end openings of the fluid conduits 141 are closed by corresponding end caps 180 except the longitudinal end openings of the fluid conduits 141 located on the upper left end in FIG. 1.

The opposed tube ends 111 of the core unit 101 are inserted into and held in the tube receiving holes 172*a* of the upper and lower header tank units 140 and are integrated together with the header tank units 140 by soldering to form the evaporator 100. The tube ends 111 are respectively positioned by the steps 171*b* of the corresponding first tank plate 171 at outside of the fluid conduits 141 of the corresponding tank arrangement 150. Furthermore, since the tube ends 111 do not protrude into the corresponding fluid conduits 141, the width Ln of the fluid conduit 141, which is measured in a direction perpendicular to the aligning direction of the tubes 110, is chosen to be smaller than the width Lt of the tube 110, which is measured in the direction perpendicular to the aligning direction of the tubes 110, as shown in FIG. 3.

Next, positional relationship of each communication hole 161 of the header tank unit 140 to the corresponding chamber 141*a*–141*e* and the corresponding tube 110 will be described in detail with reference to FIG. 1.

In the present embodiment, the tubes 110 are grouped into first to fourth tube groups 110*a*–110*d*, which are arranged in this order from an upstream side to a downstream side of the refrigerant flow. The first tube group 110*a* (upstream end tube group) and the fourth tube group 110*d* (downstream end tube group) are arranged on the left side of the core unit 101 in FIG. 1. Also, the tubes 110 of the first tube group 110*a* and the tubes 110 of the fourth tube group 110*d* are alternately arranged, as shown in FIG. 1. The second tube group 110*b* is arranged in the right end of the core unit 101 in FIG. 1, and the third tube group 110*c* is located adjacent the center of the core unit 101 on the center side of the second tube group 110*b*.

The first to fourth tube groups 110*a*–110*d* are connected to the corresponding chambers 141*a*–141*e* through the communication holes 161 in the following manner. That is, the first tube group 110*a* is communicated with the first chamber 141*a* and the second chamber 141*b*. The second tube group 110*b* is communicated with the second chamber 141*b* and the third chamber 141*c*. The third tube group 110*c* is communicated with the third chamber 141*c* and the fourth chamber 141*d*. The fourth tube group 141*d* is communicated with the fourth chamber 141*d* and the fifth chamber 141*e*. The communication holes 161 are arranged to achieve the above described communication of each tube group 110*a*–110*e* to the corresponding chambers 141*a*–141*e*.

Figure 3:
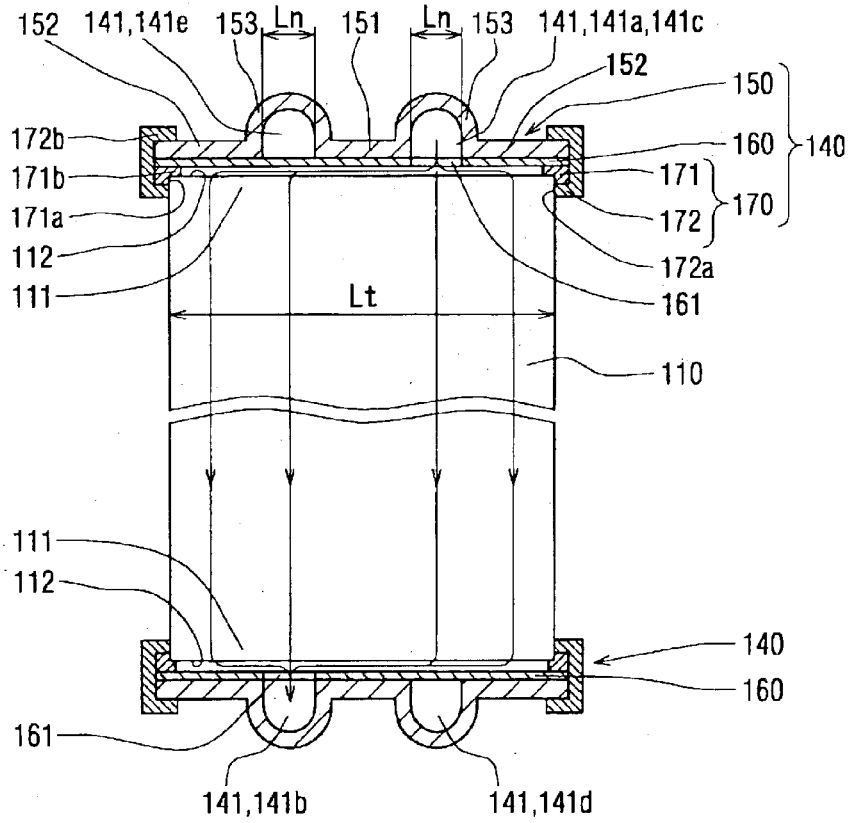
FIG. 3 is a cross sectional view along line III—III in FIG. 1 in an assembled state.

With the above arrangement of the communication holes 161, the communication holes 161 of the first, second and fourth tube groups 110*a*, 110*b*, 110*d* are positioned such that two communication holes 161 at the opposed ends of each tube 110 are diagonally opposed to each other in a lateral cross section of the evaporator 100, as shown in FIG. 3. In other words, the one end of each tube 110 is communicated with a corresponding one of the chambers 141*a*, 141*c*, 141*e* of the upper header tank unit 140 through a corresponding one of the communication holes 161 of the upper header tank unit 140 at a first position, and the other end of each tube 110 is communicated with a corresponding one of the chambers 141*b*, 141*d* of the lower header tank unit 140 through a corresponding one of the communication holes 161 of the lower header tank unit 140 at a second position that is diagonally opposed to the first position, as shown in FIG. 3.

Operation and advantages of the evaporator 100 will be described.

First, two phase refrigerant (including vapor phase and liquid phase) in the first chamber 141*a* of the upper header tank unit 140 makes a turn (first turn) and flows downward to the second chamber 141*b* of the lower header tank unit 140 through the first tube group 110*a*. Then, the refrigerant supplied to the second chamber 141*b* makes a turn (second turn) and flows upward to the third chamber 141*c* through the second tube group 110*b* located in the right end of the core unit 101. Thereafter, the refrigerant supplied to the third chamber 141*c* makes a turn (third turn) and flows downward to the fourth chamber 141*d* through the third tube group 110*c* located adjacent the center of the core unit 101. Finally, the refrigerant supplied to the fourth chamber 141*d* makes a turn (fourth turn) and flows upward to the fifth chamber 141*e* through the fourth tube group 110*d* such that the refrigerant in the fourth tube group 110*d* forms the counter flow against the refrigerant flow in the first tube group 110*a*, as shown in FIG. 1. The liquid phase refrigerant, which flows through the first to fourth tube groups 110*a*–110*d*, is vaporized through heat exchange with conditioning air (serving as the external fluid of the present invention), which flows outside of the evaporator 100, so that the conditioning air is cooled by latent heat of the vaporization.

In the evaporator 100, provision of the communication holes 161, the partition walls 151 and the separator (partition wall) 151*a* in the header tank units 140 allows supply of the refrigerant to the desired tubes 110. Thus, even in the above case where the tubes 110 are arranged in the single row, the refrigerant can flow from one end (left end in FIG. 1) of the row to the other end (right-end on FIG. 1) of the row and then can return to the one end of the row.

Furthermore, the intermediate plate 160 allows a higher degree of freedom in terms of the positions and shapes of the communication holes 161. For example, when the size of the core unit 101 needs to be changed to meet a certain design demand (this normally results in a change in the distribution of the refrigerant in the core unit 101), it is relatively easy to meet such a demand, for example, by simply changing the positions of the communication holes 161 in the intermediate plate 160 to the desired positions. In other words, such a demand can be satisfied simply by replacing the intermediate plate 160 with another intermediate plate 160 that has the appropriate communication holes 161.

At least in the initial turn (first turn) and the last turn (fourth turn), the tubes 110 of the one tube group 110*a* (forming the initial turn) and the tubes 110 of the other tube group 110*d* (forming the last turn) are alternately arranged. Thus, the refrigerant flow in the first tube group 110*a* and the refrigerant flow in the fourth tube group 110*d* are placed adjacent to one another to provide a generally uniform vapor to liquid ratio of the refrigerant in that region and thus to provide more uniform temperature distribution in the conditioning air after the heat exchange at that region.

As described above, unlike the prior art, the throttle holes are not required in the above embodiment, and the tube ends do not protrude into the corresponding chambers of the tank arrangements. Thus, an unobstructed passage is provided in each chamber 141*a*–141*e*. As a result, an increase in pressure loss of the internal fluid can be avoided, and an increase in the number of components is also avoided.

Furthermore, since the tubes 110 are aligned in the single row, it is possible to reduce the entire size of the evaporator 100 by eliminating dead spaces between rows of tubes in the prior art. Also, it is possible to reduce the number of assembling steps.

As described above, the tubes 110 of the first tube group 110*a* and the tubes 110 of the fourth tube group 110*d* are alternately arranged, so that the refrigerant flow in the first tube group 110*a* and the refrigerant flow in the fourth tube group 110*d* are in closest proximity to each other to achieve more uniform temperature distribution in the conditioning air.

The number of turns of the refrigerant is the even number (i.e., four), and the refrigerant in the first turn and the refrigerant in the fourth turn flow in opposite directions (i.e., opposed first and second directions), respectively, to provide the counter flows. As a result, the vapor to liquid ratio of the refrigerant in the longitudinal direction of the tube 110 becomes generally uniform, and thus the advantage of the uniform temperature distribution is further enhanced.

In the first, second and fourth tube groups 110*a*, 110*b*, 110*d*, the two communication holes 161 positioned adjacent the opposed tube ends 111 of each tube 110 are diagonally opposed, as shown in FIG. 3. Thus, the refrigerant flows throughly in the tube 110 to restrain a reduction in the flow rate of the refrigerant in the tube 110.

Since the header tank unit 140 is formed by stacking the tank arrangement 150, the intermediate plate 160 and the tank plate arrangement 170 in this order, the communication holes 161 can be formed by simply forming the corresponding holes through the intermediate plate 160 at the predetermined positions. Furthermore, the header tank unit 140 is formed by the simple combination of the above-described components, so that the relatively low manufacturing costs can be achieved.

In the present embodiment, since the tube ends 111 of the tubes 110 do not protrude into the corresponding fluid conduit 141 of each header tank unit 140, turbulence of the refrigerant flow is not induced by the tube ends 111 to minimize the flow resistance of the refrigerant. Thus, the width Ln of the fluid conduit 141 can be made smaller than the width Lt of the tube 110 to reduce the size of each header tank unit 140.

Because of the overall size reduction of each fluid conduit 141, the wall surface area within the fluid conduit 141 is reduced. Thus, the fracturing force (tensile force) applied from the internal pressure of the refrigerant fluid to the wall of the fluid conduit 141 can be reduced to improve the pressure resistivity of the wall of the fluid conduit 141.

Figure 4:
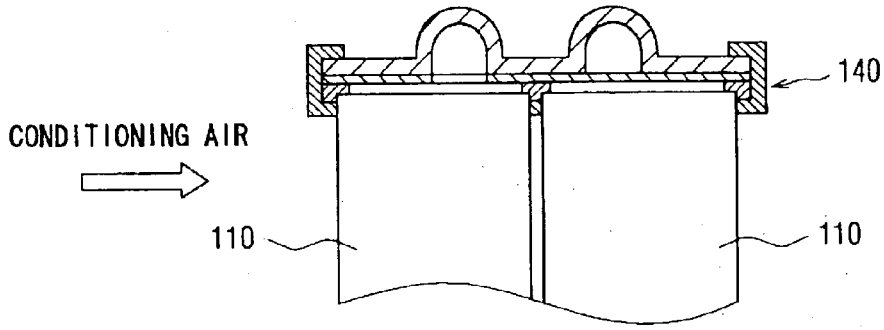
FIG. 4 is a partial cross sectional view showing a first variation of the first embodiment.

In the above embodiment, the tubes 110 are arranged in the single row. Alternatively, the tubes 110 can be arranged in a plurality of rows, which are arranged in the flow direction of the conditioning air (external fluid), as shown in FIG. 4. In this way, the temperature distribution can be adjusted along the flow direction of the conditioning air. In addition, when the refrigerant flow in one of the rows of tubes 110, which is located on the upstream side of the conditioning air, forms the counter flow against the refrigerant flow in a next adjacent one of the rows of tubes 110, which is located on the downstream side of the conditioning air, the more uniform vapor to liquid ratio of the refrigerant in the longitudinal direction of the tube 110 can be achieved to further enhance the advantage of the uniform temperature distribution.

(Second Embodiment)

A second embodiment of the present invention will be described with reference to FIG. 5. In the second embodiment, sizes (i.e., cross sectional areas) of the communication holes 161 of the first embodiment are modified.

Figure 5:
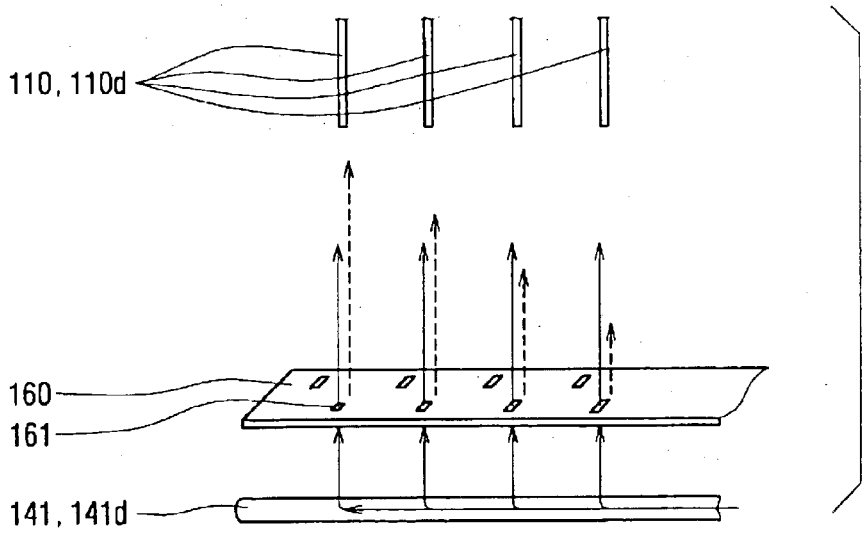
FIG. 5 is a schematic perspective view showing communication holes and flow of refrigerant according to a second embodiment.

For, example, when the refrigerant flows from the third turn to the fourth turn in the core unit 101 in the upward direction, the greater amount of refrigerant tends to be supplied to the left end (i.e., the downstream end) of the fourth chamber 141*d* in FIG. 5 due to the inertia of the refrigerant (liquid phase refrigerant). Thus, the non-uniform refrigerant distribution could be developed in the fourth chamber 141*d*, as indicated by dotted lines in FIG. 5. To address this, in the second embodiment, cross sectional areas of the communication holes 161 at the fourth tube group 110*d* are selected such that the cross sectional area of the communication hole 161 is increased from the downstream side to the upstream side where the flow rate of the refrigerant is smaller in comparison to the downstream side. Alternatively, such adjustment of the cross sectional areas of the communication holes 161 can be implemented among the tube groups 110*a*–110*d*.

In this way, the more uniform flow rate of the refrigerant can be achieved in the tube groups 110*a*–110*d* or in each tube group 110*a*–110*d*, so that the more uniform temperature distribution can be achieved in the aligning direction of the tubes 110.

(Third Embodiment)

A third embodiment of the present invention will be described with reference to FIGS. 6 and 7. In the third embodiment, the structure of each header tank unit 140 is simplified with respect to the corresponding header tank unit 140 of the first embodiment.

Figure 6:
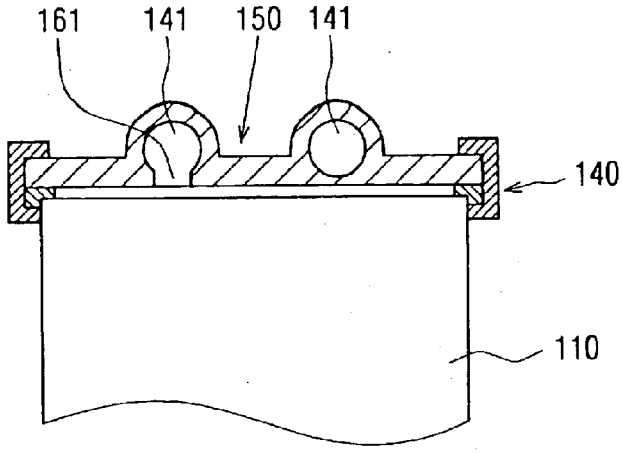
FIG. 6 is a partial cross sectional view showing a header tank unit (first variation) of an evaporator according to a third embodiment of the present invention.

With reference to FIG. 6, which shows a first exemplary variation according to the third embodiment, each tank arrangement 150 is formed as an integral body through an extrusion process to have closed fluid conduits (i.e., conduits having a closed lower end in FIG. 6) 141, as indicated on the right side in FIG. 6. In this case, the communication holes 161 are formed in the required positions in each tank arrangement 150 in the following manufacturing process, as indicated on the left side in FIG. 6.

In this way, the intermediate plate 160 can be integrated with the tank arrangement 150 or can be eliminated to reduce the manufacturing costs. In addition, there is a higher degree of freedom in terms of the shape of the cross section of the fluid conduit 141. For example, the cross section of the fluid conduit 141 can be circular to increase the pressure resistivity.

Figure 7:
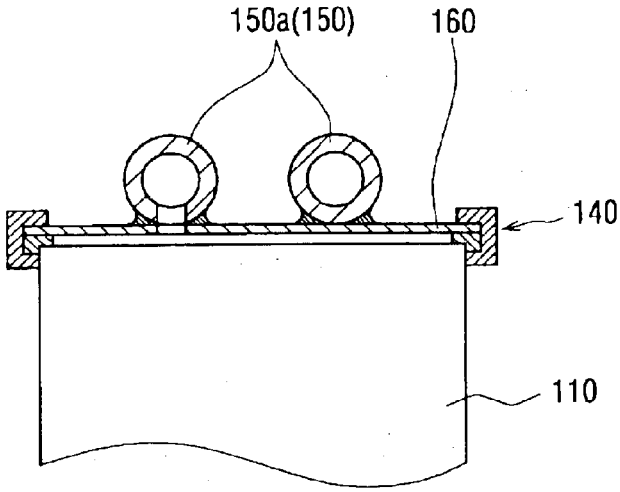
FIG. 7 is a partial cross sectional view showing a second variation of the header tank unit according to the third embodiment.

With reference to FIG. 7, which shows a second exemplary variation according to the third embodiment, the tank arrangement 150 can be made of pipe members 150*a*, which are joined to the intermediate plate 160. The pipe members 150*a* allow elimination of the manufacturing process of the tank arrangement 150 and can be implemented at relatively low manufacturing costs.

Figure 8:
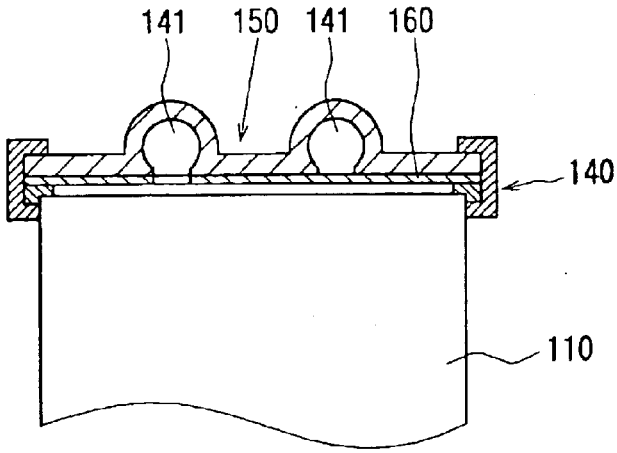
FIG. 8 is a partial cross sectional view showing a third variation of the header tank unit according to the third embodiment.

Furthermore, as shown in FIG. 8, the first embodiment and the first exemplary variation of the third embodiment can be combined (i.e., combination of the tank arrangement 150 made through the extrusion process and the intermediate plate 160). In this case, each fluid conduit 141 of the tank arrangement 150 is provided with each corresponding opening on the intermediate plate 160 side of the tank arrangement 150.

(Fourth Embodiment)

A fourth embodiment of the present invention will be described with reference to FIGS. 9 to 12. In the fourth embodiment, the tubes 110 are bent, and one of the header tank units 140 is eliminated to provide the single header tank unit 140 in the evaporator 100.

Figure 9:
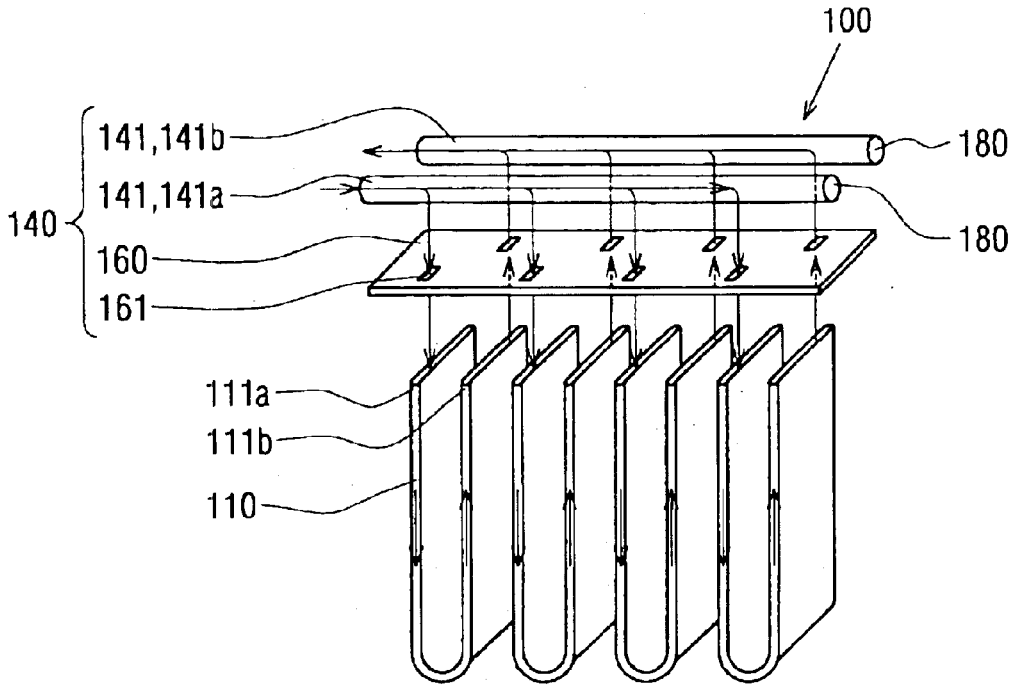
FIG. 9 is a schematic perspective view showing a disassembled state of an evaporator (first variation) according to a fourth embodiment of the present invention.

With reference to FIG. 9, which shows a first exemplary variation according to the fourth embodiment, each tube 110 is bent about 180 degrees, so that tube ends 111*a*, 111*b* of the tubes 110 are oriented in the same direction (common direction) and are arranged in a single row. Similar to the first embodiment, the single header tank unit 140 includes the fluid conduits 141 defined by the corresponding partition walls 151 at the longitudinal ends to form the first chamber 141*a* and the second chamber 141*b*, which extend in the aligning direction of the tubes 110. The tube ends 111*a*, 111*b* are connected to the header tank unit 140.

The communication holes 161 are formed in the intermediate plate 160 to communicate between the first chamber 141*a* and one tube end 111*a* of each tube 110 and also to communicate between the second chamber 141*b* and the other end 111*b* of each tube 110.

With this arrangement, only one header tank unit 140 is used in the evaporator 100, and thus it is possible to reduce the manufacturing costs of the evaporator 100. Furthermore, when each straight segment of each tube 110 (in the case of FIG. 9, each tube 110 has two straight segments), which extends in the vertical direction in FIG. 9, is considered as one of the tubes 110 of the first embodiment, the number of tubes 110, to which the refrigerant is supplied, is advantageously reduced in the fourth embodiment. As a result, the relatively uniform vapor to liquid ratio of the refrigerant can be achieved in the tubes 110, and the relatively uniform temperature distribution of the conditioning air can be achieved.

Figure 10:
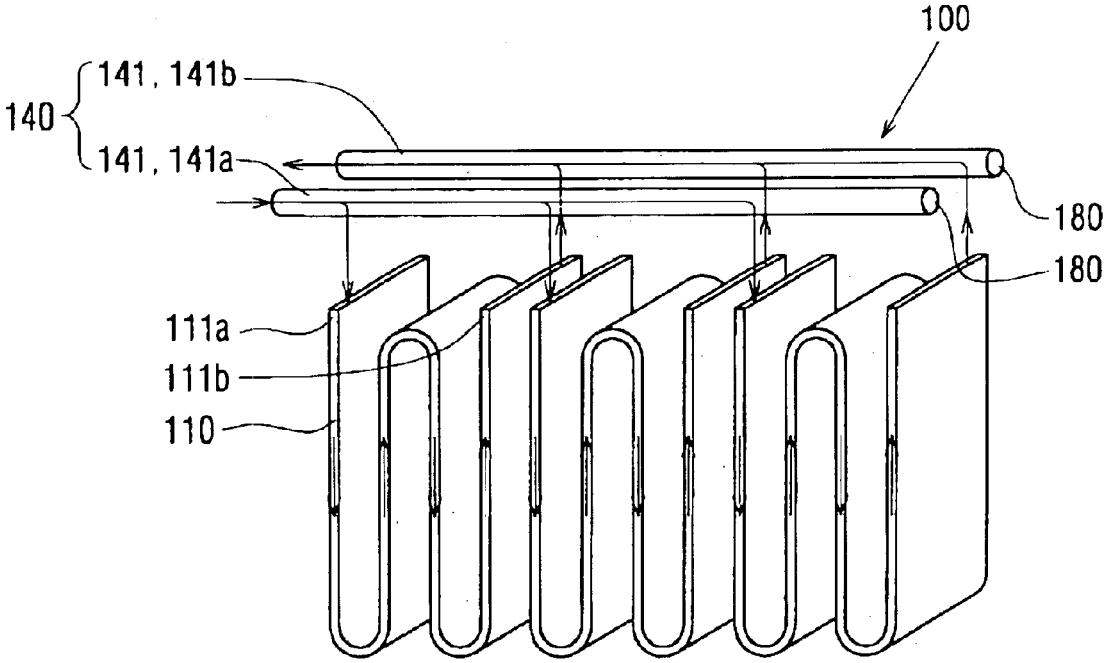
FIG. 10 is a schematic perspective view showing a disassembled sate of a second variation of the evaporator according to the fourth embodiment.

With reference to FIG. 10, which shows a second exemplary variation according to the fourth embodiment, as long as the number of turns in each tube 110 is an even number, the number of turns in each tube 110 can be further increased (the number of turns of the tube 110 is three in this instance). By increasing the number of turns in each tube 110, the number of tubes 110 can be reduced while achieving the relatively uniform vapor to liquid ratio of the refrigerant. In such a case, as the length of the tube 110 increases, the pressure loss of the refrigerant is increased. Thus, the number of turns in the tube 110 should be determined upon consideration of the balance between the advantage of the uniform vapor to liquid ratio of the refrigerant and the increase of the pressure loss of the refrigerant.

Figure 11:
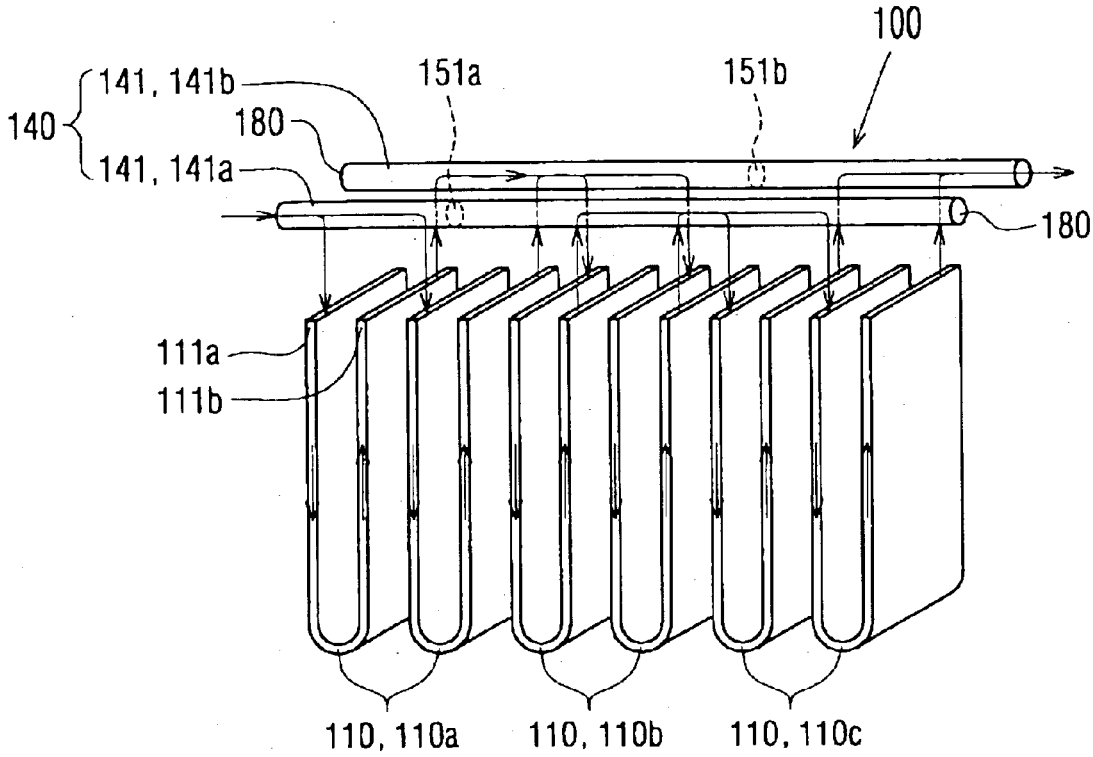
FIG. 11 is a schematic perspective view showing a disassembled sate of a third variation of the evaporator according to the fourth embodiment.

Furthermore, with reference to FIG. 11, which shows a third exemplary variation according to the fourth embodiment, separators 151*a*, 151*b* can be arranged in the first chamber 141*a* and the second chamber 141*b*, respectively, so that the refrigerant flows through first to third tube groups 110*a*–110*c*, which are arranged in a left-right direction in FIG. 11.

Figure 12:
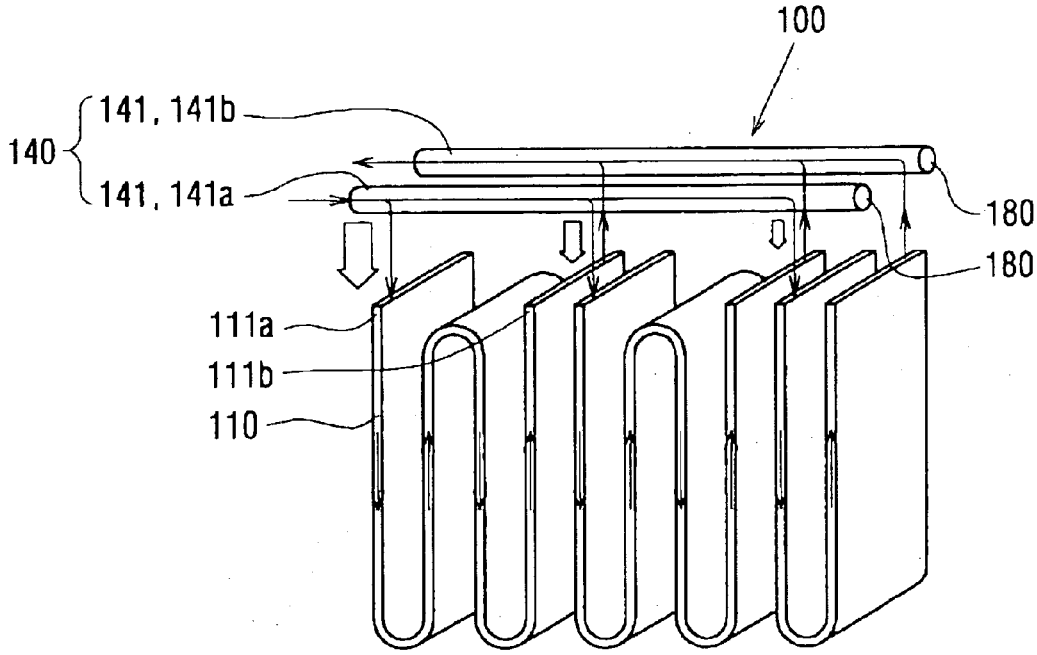
FIG. 12 is a schematic perspective view showing a disassembled sate of a fourth variation of the evaporator according to the fourth embodiment.

Furthermore, with reference to FIG. 12, which shows a fourth exemplary variation according to the fourth embodiment, it is possible to combine different types of tubes 110, which have different number of turns.

That is, as shown in FIG. 12, it is difficult for the liquid phase refrigerant to reach the right end of the first chamber 141*a* in FIG. 12 due to the effect of the gravity, so that there is the tendency to have the quantitative gradient of the refrigerant in the first chamber 141*a*, as indicated by blank arrows. Because of this, the number of turns of the tube 110 is reduced in the reduced quantity region where the quantity of the supplied refrigerant is lower than that of the other regions. In this way, the more uniform vapor to liquid ratio of the refrigerant in the tubes 110 is achieved, and thus the more uniform temperature distribution is achieved.

(Fifth Embodiment)

Figure 13:
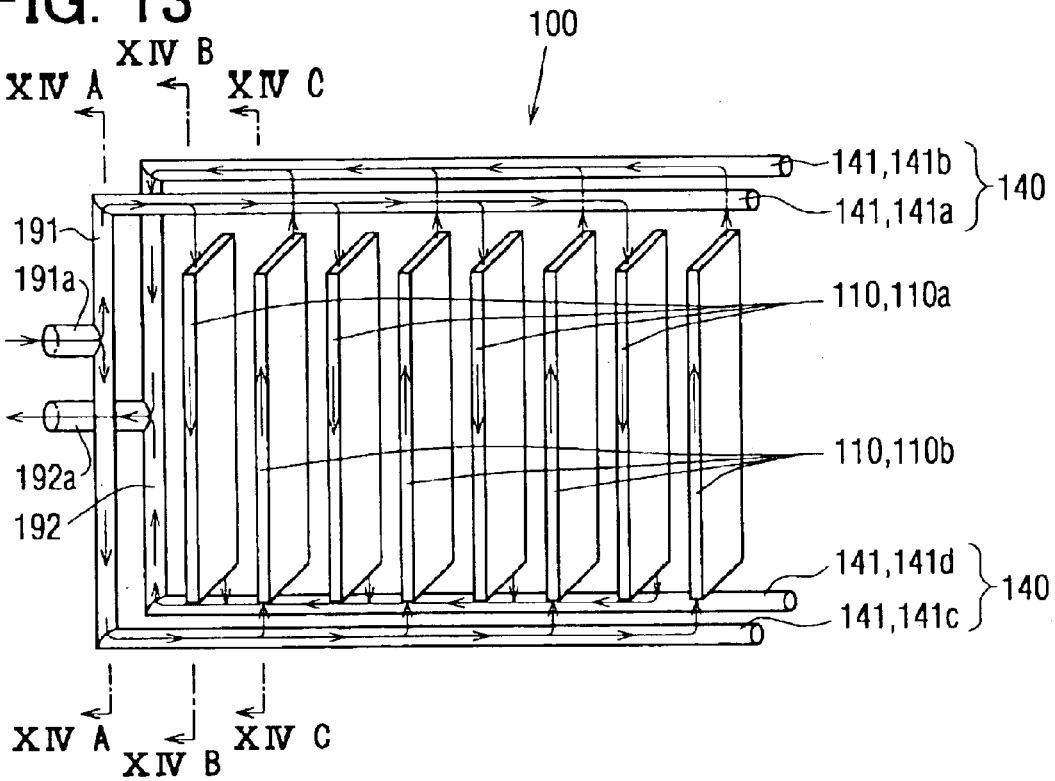
FIG. 13 is a schematic perspective view showing a disassembled state of a gas cooler (first variation) according to a fifth embodiment of the present invention, indicating a structure of the gas cooler and flow of refrigerant in the gas cooler.
Figure 14A:
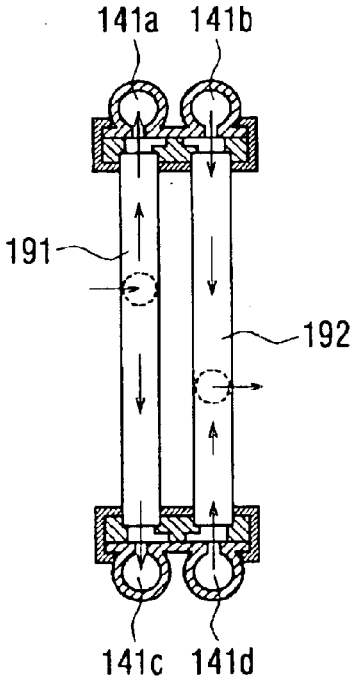
FIG. 14A is a cross sectional view along line XIVA—XIVA in FIG. 13.
Figure 14B:
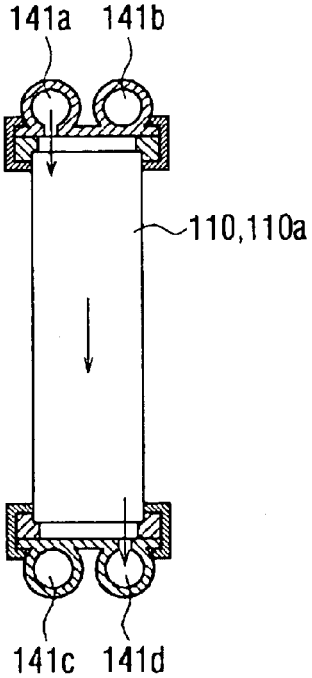
FIG. 14B is a cross sectional view along line XIVB—XIVB in FIG. 13.
Figure 14C:
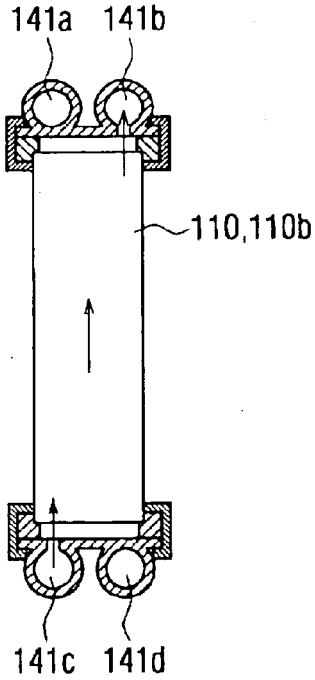
FIG. 14C is a cross sectional view along line XIVC—XIVC in FIG. 13.

FIGS. 13–14C show a first exemplary variation according to a fifth embodiment of the present invention. In the fifth embodiment, an inflow communication passage 191 and an outflow communication passage 192 are provided in the arrangement of the first embodiment to communicate between the upper header tank unit 140 and the lower header tank unit 140. In this instance, the heat exchanger is a passenger room side heat exchanger (gas cooler) 100 of a heat pump cycle system, which uses, for example, carbon dioxide as the refrigerant.

The upper header tank unit 140 includes the first chamber 141*a* and the second chamber 141*b*, and the lower header tank unit 140 includes the third chamber 141*c* and the fourth chamber 141*d*. The inflow communication passage 191 communicates between the first chamber 141*a* and the third chamber 141*c*. The outflow communication passage 192 communicates between the second chamber 141*b* and the fourth chamber 141*d*. A flow inlet 191*a* is provided in an intermediate point in the inflow communication passage 191, and a flow outlet 192*a* is provided in an intermediate point in the outflow communication passage 192. The first chamber 141*a* and the fourth chamber 141*d* are communicated with each other through the corresponding communication holes 161 (not shown in FIG. 13) and the tubes 110 of the first tube group 110*a*. Furthermore, the third chamber 141*c* and the second chamber 141*b* are communicated with each other through the corresponding communication holes 161 (not shown in FIG. 13) and the tubes 110 of the second tube group 110*b*. The tubes 110 of the first tube group 110*a* and the tubes 110 of the second tube group 110*b* are alternately arranged.

In the gas cooler 100, the refrigerant supplied through the flow inlet 191*a* is distributed to the first chamber 141*a* and the third chamber 141*c* through the inflow communication passage 191. Thereafter, the refrigerant supplied to the first chamber 141*a* flows downward through the first tube group 110*a* to the fourth chamber 141*d*, and the refrigerant supplied to the third chamber 141*c* flows upward through the second tube group 110*b* to the second chamber 141*b*, so that conditioning air is heated. Thereafter, the refrigerant supplied to the fourth chamber 141*d* and the refrigerant supplied to the second chamber 141*b* are merged in the outflow communication passage 192 and is drained through the flow outlet 192*a*.

In this way, the design of the inflow opening position for supplying the refrigerant to the tubes 110 and the outflow opening position for draining the refrigerant from the tubes 110 is eased, so that the adjustment of the temperature distribution is eased. That is, the counter flows of the refrigerant can be formed between the adjacent tubes 110, and thus the above arrangement can be advantageously applied to the above described type of heat exchanger, such as the gas cooler 100 where the relatively large temperature difference is developed between the upstream side and the downstream side in each tube 110.

Figure 15A:
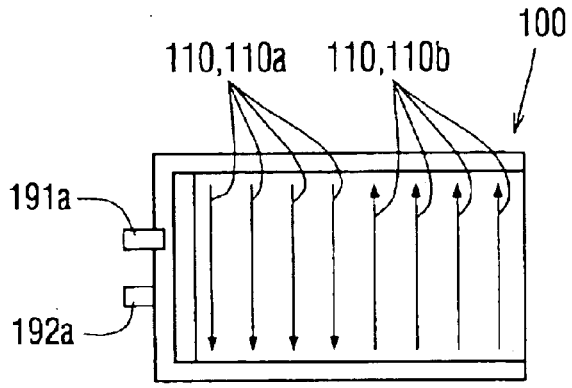
FIG. 15A is a schematic view showing a modification of flow of refrigerant in the gas cooler of FIG. 13.

The tubes 110 of the first tube group 110*a* and the tubes 110 of the second tube group 110*b* are not necessary alternately arranged in the manner described above. Alternately, as shown in FIG. 15A, the entire first tube group 110*a* can be arranged next the entire second tube group 110*b* in the aligning direction of the tubes 110. In the case where the number of tubes 110 of the gas cooler 100 is relatively large, and the length of each tube 110 is relatively short, the above arrangement is effective to reduce the temperature difference of the conditioning air (i.e., to make the more uniform temperature distribution) between the left side region and the right side region in FIG. 15A.

Figure 15B:
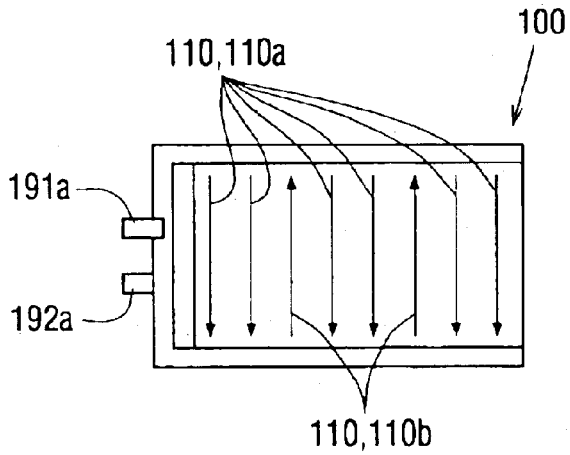
FIG. 15B is a schematic view showing another modification of flow of refrigerant in the gas cooler of FIG. 13.

Furthermore, as shown in FIG. 15B, the number of the tubes 110 of the first tube group 110*a* can be increased over the number of the tubes 110 of the second tube group 110*b*. With this arrangement, the temperature difference can be intentionally created between the upper side and the lower side in FIG. 15B. This arrangement is suitable for the gas cooler 100, which includes two air layer (i.e., the inside air layer and outside air layer) unit.

Figure 15C:
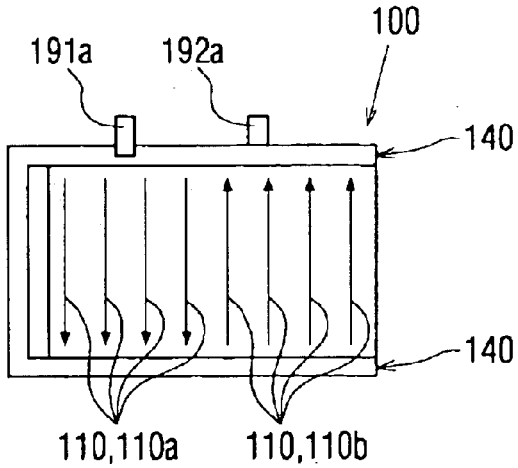
FIG. 15C is a schematic view showing a modification of positions of a flow inlet and a flow outlet of the gas cooler of FIG. 13.

Also, as shown in FIG. 15C, the flow inlet 191*a* of the inflow communication passage 191 and the flow outlet 192*a* of the outflow communication passage 192 can be provided in the upper header tank unit 140 to provide greater freedom in terms of refrigerant piping design.

Figure 16:
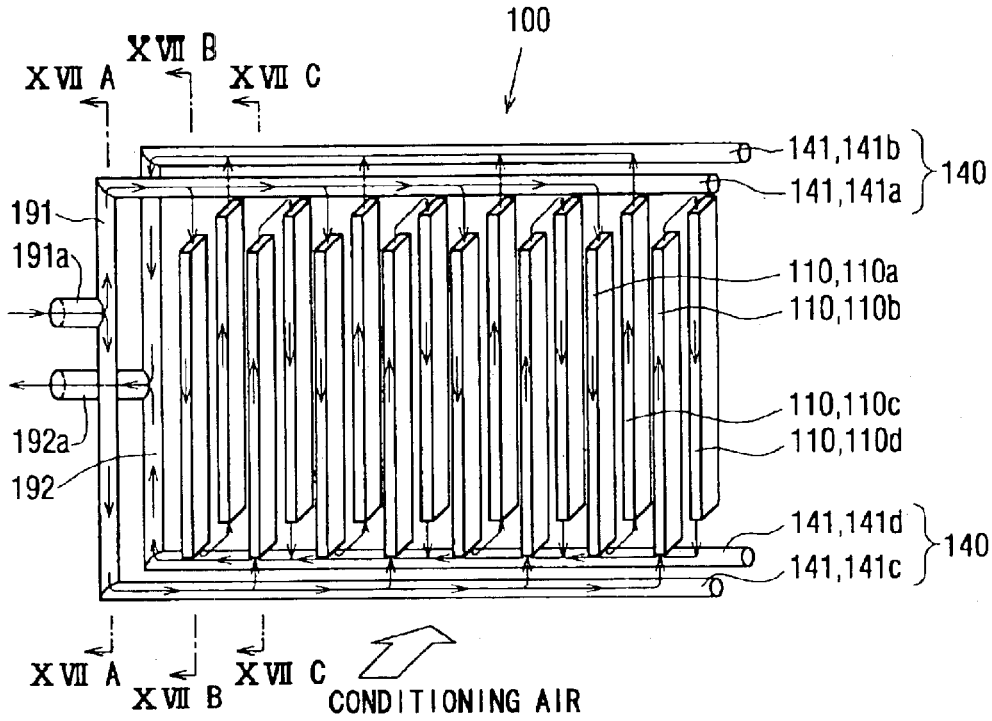
FIG. 16 is a schematic perspective view showing a second variation of the gas cooler according to the fifth embodiment, indicating a structure of the gas cooler and flow of refrigerant in the gas cooler.
Figure 17A:
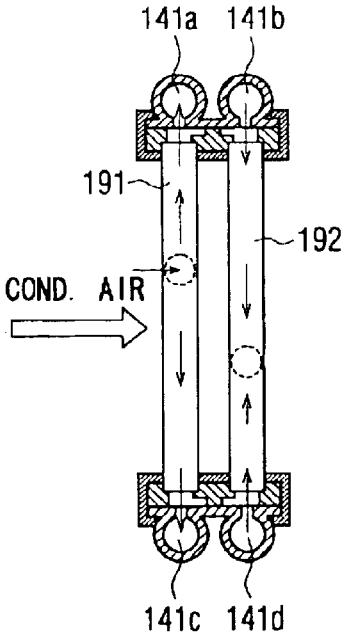
FIG. 17A is a cross sectional view along line XVIIA—XVIIA in FIG. 16.
Figure 17B:
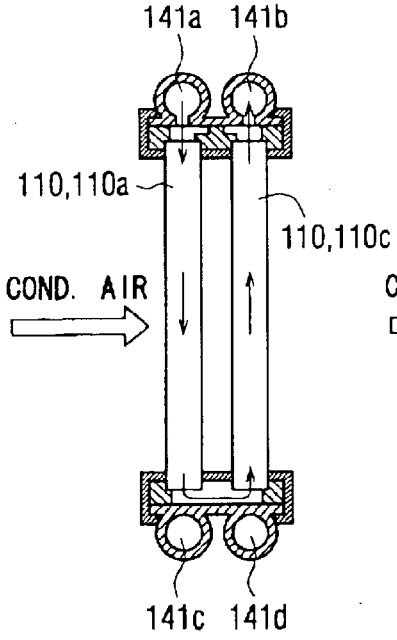
FIG. 17B is a cross sectional view along line XVIIB—XVIIB in FIG. 16.
Figure 17C:
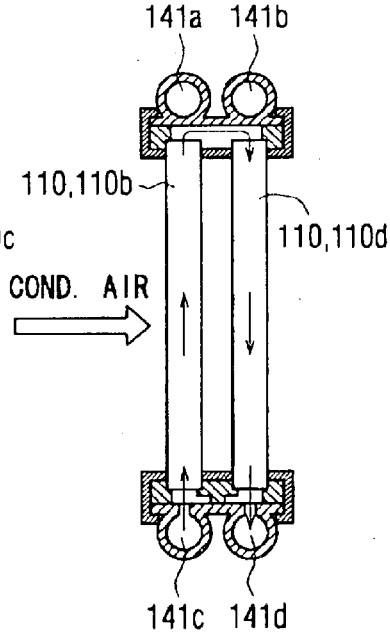
FIG. 17C is a cross sectional view along line XVIIC—XVIIC in FIG. 16.

Furthermore, as shown in FIGS. 16–17C, the tubes 110 can be arranged in a plurality of rows in the flow direction of the conditioning air. More specifically, in this instance, the first tube group 110*a* and the second tube group 110*b* are arranged on the upstream side in the flow of the conditioning air, and the third tube group 110*c* and the fourth tube group 110*d* are arranged on the downstream side. The refrigerant flows in the adjacent tube groups 110*a*–110*d*, which are arranged in the aligning direction of the tubes 110 or in the flow direction of the conditioning air, form the counter flows, as shown in FIG. 16.

In this way, the advantages similar to those discussed with reference to FIG. 4 in the first embodiment can be achieved.

(Other Embodiments)

In the first (or second or third) embodiment, the entire second tube group 110*b* and the entire third tube group 110*c* are arranged adjacent to each other. Alternately, the tubes 110 of the second tube group 110*b* and the tubes 110 of the third tube group 110*c* can be alternately arranged. Furthermore, the tubes 110 of the second tube group 110*b* and the tubes 110 of the third tube group 110*c* can be mixed in the following manner. That is, the tubes 110 of the second tube group 110*b* may be divided into subgroups, each of which contains two or more tubes 110, and the tubes 110 of the third tube group 110*c* may be divided into subgroups, each of which contains two or more tubes 110. Then, the subgroups of the second tube group 110*b* and the subgroups of the third tube group 110*c* can be alternately arranged. Here, it is only required that at least one of the tubes 110 in one of adjacent two tube groups 110*b*, 110*c* is positioned between two of the tubes 110 in the other one of the adjacent two tube groups 110*b*, 110*c*. This is also equally applicable to the tubes 110 of the first tube group 110*a* and the tubes 110 of the fourth tube group 110*d* in the first embodiment to provide a different pattern of tube mixing.

Figure 18:
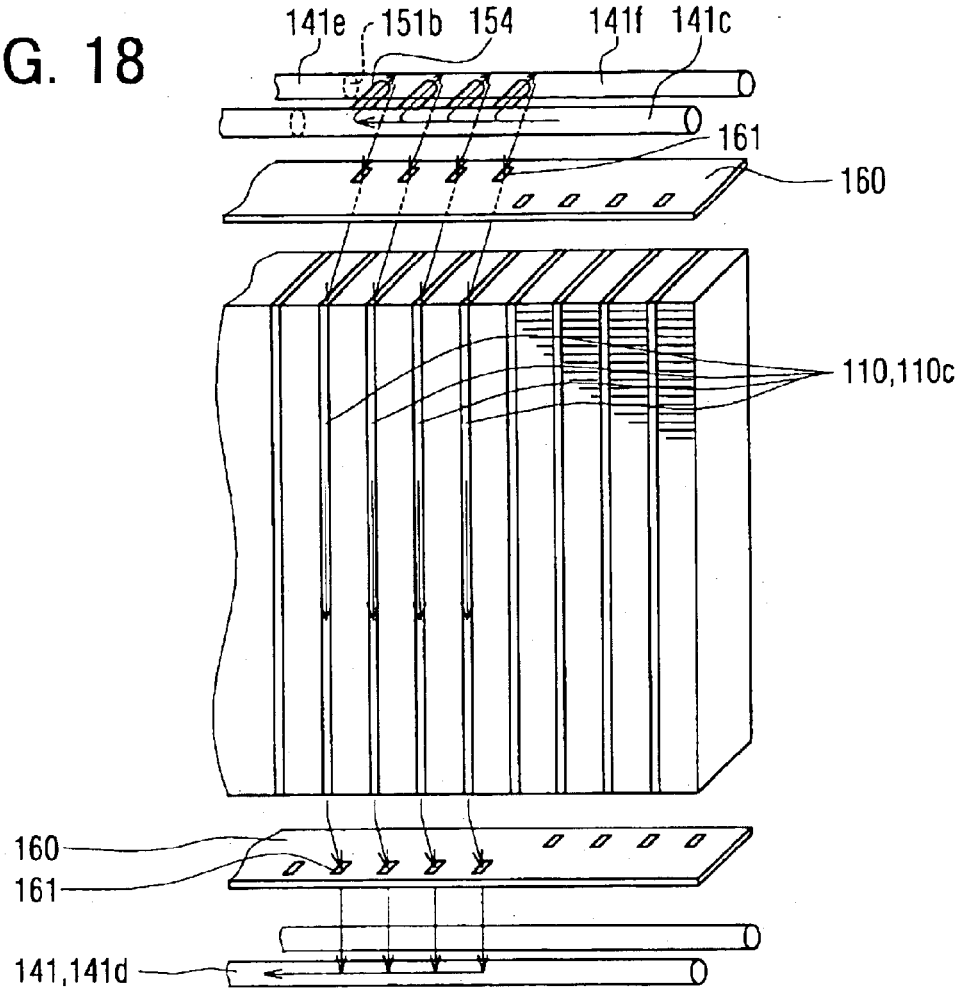
FIG. 18 is a schematic partial perspective view showing a modification of the first embodiment.

Furthermore, in the third tube group 110*c*, the opposed communication holes 161 of each tube 110 are not diagonally opposed. Alternately, a separator 151*b* can be provided in the fifth chamber 141*e* to create a sixth chamber 141*f*, and a plurality of communication passages 154 can be provided to communicate between the third chamber 141*c* and the sixth chamber 141*f*, as shown in FIG. 18. With this arrangement, the opposed communication holes 161 of each tube 110 of the third tube group 110*c* can be arranged to diagonally oppose each other to restrain a reduction in the flow rate of the refrigerant.

Figure 19:
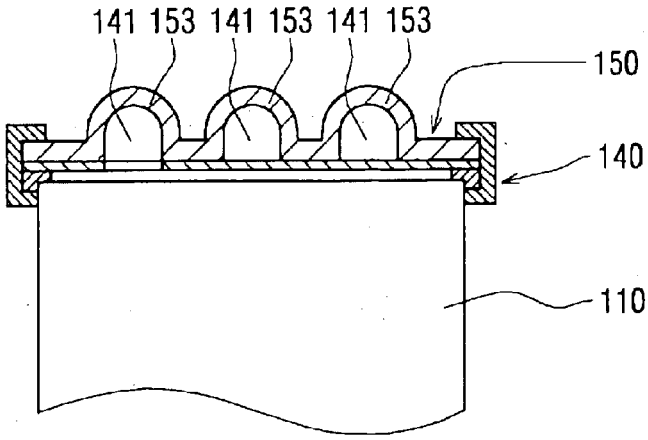
FIG. 19 is a partial cross sectional view showing another modification.
Figure 20:
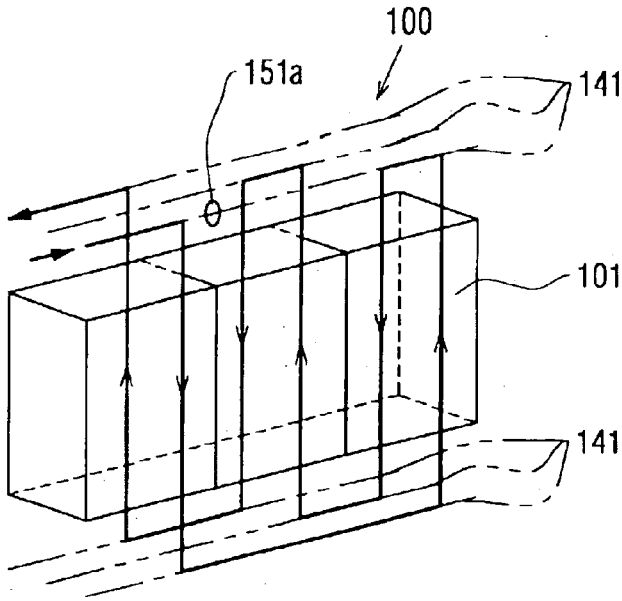
FIG. 20 is a schematic perspective view showing a modification of flow of refrigerant through header tank units of FIG. 19.
Figure 21:
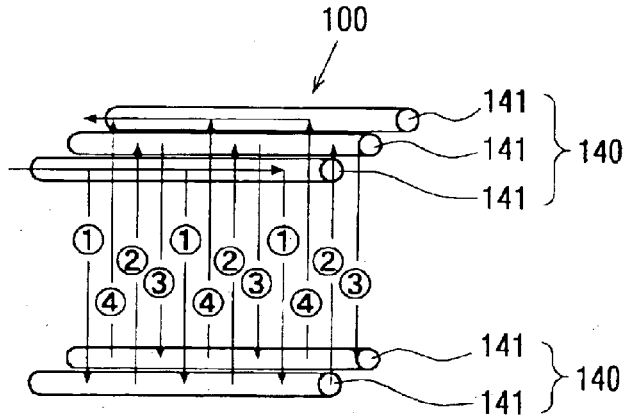
FIG. 21 is a schematic perspective view showing another modification of flow of refrigerant.

Also, the number of fluid conduits 141 of the header tank unit 140, which are formed by the protrusions 153 of the tank arrangement 150, can be set based on the number of turns of refrigerant flow. For example, as shown in FIGS. 19 and 20, when the number of turns of refrigerant flow is six, three fluid conduits 141 can be provided in the header tank unit 140. Furthermore, as shown in FIG. 21, the number of the fluid conduits 141 in the upper header tank unit 140 can be different from the number of the fluid conduits 141 in the lower header tank unit 140 (e.g., three fluid conduits 141 in the upper header tank unit 140, and two fluid conduits 141 in the lower header tank unit 140), and variety of refrigerant flow patterns are possible.

Figure 22:
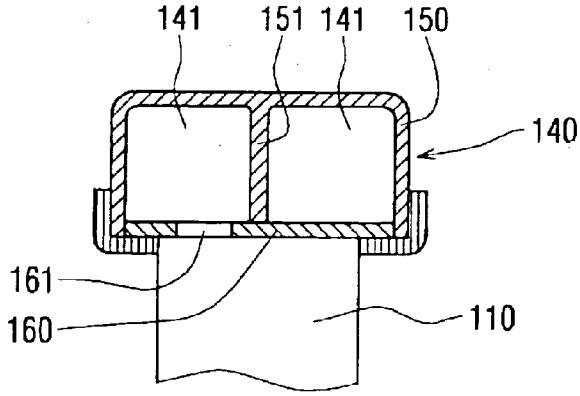
FIG. 22 is a schematic partial cross sectional view showing a modification of the header tank unit.

Each header tank unit 140 is not limited to the above described one where the width Ln of the fluid conduit 141 is smaller than the width Lt of the tube 110. For example, as shown in FIG. 22, a box type tank arrangement 150, which has the width greater than the width of the tube 110 and has a flat plate shaped partition wall 151 therein, can be used.

Furthermore, in the above embodiments, the evaporator 100 or the gas cooler 100 is used as the heat exchanger of the present invention. The invention is not limited to this. The present invention is also equally applicable to, for example, a heater core or any other suitable heat exchanger.

Additional advantages and modifications will readily occur to those skilled in the art. The invention in its broader terms is therefore not limited to the specific details, representative apparatus, and illustrative examples shown and described.

What is claimed is:

1. A heat exchanger for exchanging heat between internal fluid inside the heat exchanger and external fluid outside the heat exchanger, the heat exchanger comprising:

a plurality of aligned tubes which are arranged one after another in an aligning direction; and at least one header tank unit, each of which includes:

a plurality of fluid conduits which extend parallel to the aligning direction of the plurality of tubes and which are in communication with the plurality of tubes; and a communication hole defining means for defining a plurality of communication holes therethrough, wherein:

each communication hole communicates between a corresponding one of the plurality of tubes and a corresponding one of the plurality of fluid conduits of the header tank unit such that each tube is spaced apart from the corresponding one of the plurality of fluid conduits;

one of the plurality of fluid conduits of the header tank unit is directly in communication with one of predetermined adjacent two of the plurality of tubes through a corresponding one of the plurality of communication holes and is not in communication with the other one of the predetermined adjacent two of the plurality of tubes due to the communication hole defining means; and the predetermined adjacent two of the plurality of tube are adjacent to one another and are located within a longitudinal extent of the one of the plurality of fluid conduits of the header tank.

2. A heat exchanger according to claim 1, wherein:

the plurality of tubes are divided into a plurality of tube groups, each of which includes more than one of the plurality of tubes and conducts internal fluid in a common direction; and at least one of the tubes in one of adjacent two of the tube groups is positioned between two of the tubes in the other one of the adjacent two of the tube groups.

3. A heat exchanger according to claim 2, wherein the tubes of the one of the adjacent two of the tube groups and the tubes of the other one of the adjacent two of the tube groups are alternately arranged.

4. A heat exchanger according to claim 2, wherein:

the one of the adjacent two of the tube groups is arranged to conduct internal fluid in a first direction; and the other one of the adjacent two of the tube groups is arranged to conduct internal fluid in a second direction that is opposite to the first direction.

5. A heat exchanger according to claim 1, wherein a cross sectional area of one of the plurality of communication holes of at least one of the at least one header tank unit is larger than a cross sectional area of at least another one of the plurality of communication holes located downstream of the one of the plurality of communication holes.

6. A heat exchanger according to claim 1, wherein:

the at least one header tank unit includes opposed first and second header tank units;

the first header tank unit is positioned at one end of each corresponding tube, and the second header tank unit is positioned at the other end of each corresponding tube; and the one end of at least one of the plurality of tubes is in communication with a corresponding one of the plurality of fluid conduits of the first header tank unit through a corresponding one of the plurality of communication holes of the first header tank unit at a first position, and the other end of the at least one of the plurality of tubes is in communication with a corresponding one of the plurality of fluid conduits of the second header tank unit through a corresponding one of the plurality of communication holes of the second header tank unit at a second position, wherein the first position and the second position are diagonally opposed to each other.

7. A heat exchanger according to claim 1, wherein the plurality of tubes are arranged in a plurality of rows, which are arranged in a flow direction of external fluid, which flows outside the heat exchanger.

8. A heat exchanger according to claim 7, wherein one of adjacent two of the plurality of tubes, which are arranged in the flow direction of the external fluid and are arranged in a different ones of the rows, respectively, conducts internal fluid in one direction, and the other one of the adjacent two of the plurality of tubes conducts internal fluid in an opposite direction that is opposite to the one direction.

9. A heat exchanger according to claim 2, wherein:

the one of the adjacent two of the tube groups is an upstream end tube group among the plurality of tube groups; and the other one of the adjacent two of the tube groups is a downstream end tube group among the plurality of tube groups.

10. A heat exchanger according to claim 1, wherein:

each tube has at least one bend, which is bent generally 180 degrees such that the number of the at least one bend is an odd number, and thus every tube end of each tube is oriented in a common direction; and the at least one header tank unit includes only one header tank unit.

11. A heat exchanger according to claim 10, wherein the number of the at least one bend in one of adjacent two of the plurality of tubes, which is located on an upstream side of the other one of the adjacent two of the plurality of tubes, is greater than the number of the at least one bend in the other one of the adjacent two of the plurality of tubes.

12. A heat exchanger according to claim 1, wherein:

the at least one header tank unit includes opposed first and second header tank units;

the first header tank unit is positioned at one end of each corresponding tube, and the second header tank unit is positioned at the other end of each corresponding tube; and the heat exchanger further comprises an inflow communication passage, which is in communication with the first and second header tank units to conduct inflow of internal fluid to the first and second header tank units, and an outflow communication passage, which is in communication with the first and second header tank units to conduct outflow of internal fluid from the first and second header tank units.

13. A heat exchanger according to claim 1, wherein each header tank unit includes:

a tank arrangement that includes:

two flat portions that lie in an imaginary plane; and a plurality of protrusions that are positioned between the two flat portions and respectively define the plurality of fluid conduits therein;

the communication hole defining means is an intermediate plate that is generally flat and defines the plurality of communication holes therethrough; and a tank plate arrangement that holds the plurality of tubes and communicates between the plurality of tubes and the communication holes of the intermediate plate, respectively, wherein the tank arrangement, the intermediate plate and the tank plate arrangement are stacked in this order.

14. A heat exchanger according to claim 13, wherein the tank arrangement and the intermediate plate are integrally formed together.

15. A heat exchanger according to claim 13, wherein the tank arrangement is an integral body formed by extrusion.

16. A heat exchanger according to claim 1, wherein each header tank unit includes:

a tank arrangement that includes a plurality of pipe members, each of which defines a corresponding one of the plurality of fluid conduits therein;

the communication hole defining means, is an intermediate plate that is generally flat and defines the plurality of communication holes therethrough, wherein the plurality of pipe members of the tank arrangement are joined to the intermediate plate; and a tank plate arrangement that holds the plurality of tubes and communicates between the plurality of tubes and the communication holes of the intermediate plate, respectively, wherein the tank arrangement, the intermediate plate and the tank plate arrangement are stacked in this order.

17. A heat exchanger according to claim 1, wherein a width of each fluid conduit, which is measured in a direction perpendicular to the aligning direction of the aligned tubes, is smaller than a width of each tube, which is measured in the direction perpendicular to the aligning direction of the aligned tubes.

18. A heat exchanger according to claim 1, further comprising at least one partition wall, each of which is placed in a corresponding one of the plurality of fluid conduits.

19. A heat exchanger for exchanging heat between internal fluid inside the heat exchanger and external fluid outside the heat exchanger, the heat exchanger comprising:

a plurality of aligned tubes which are arranged one after another in an aligning direction; and at least one header tank unit, each of which includes:

a plurality of fluid conduits which extend parallel to the aligning direction of the plurality of tubes and which are in communication with the plurality of tubes; and a communication hole defining means for defining a plurality of communication holes therethrough, wherein:

each communication hole communicates between a corresponding one of the plurality of tubes and a corresponding one of the plurality of fluid conduits of the header tank unit such that each tube is spaced apart from the corresponding one of the plurality of fluid conduits;

one of the plurality of fluid conduits of the header tank unit is directly in communication with at least one of at least two of the plurality of tubes through a corresponding one of the plurality of communication holes and is not in communication with at least another one of the at least two of the plurality of tubes due to the communication hole defining means; and the at least two of the plurality of tubes are located within a longitudinal extent of the one of the plurality of fluid conduits of the header tank.

20. A heat exchanger for exchanging heat between internal fluid inside the heat exchanger and external fluid outside the heat exchanger, the heat exchanger comprising:

a plurality of aligned tubes; and at least one header tank unit, each of which includes:

a plurality of fluid conduits in communication with the plurality of aligned tubes, wherein all of the plurality of fluid conduits are located within a width of each tube, which is measured in a direction perpendicular to an aligning direction of the plurality of aligned tubes; and a communication hole defining means for defining a plurality of communication holes therethrough, wherein each communication hole communicates between a corresponding one of the plurality of tubes and a corresponding one of the plurality of fluid conduits of the header tank unit such that each tube is spaced apart from the corresponding one of the plurality of fluid conduits.

* * * * *